US007140425B2

(12) United States Patent
Romero-Beltran

(10) Patent No.: US 7,140,425 B2
(45) Date of Patent: Nov. 28, 2006

(54) PLATE-TUBE TYPE HEAT EXCHANGER

(76) Inventor: Julian Romero-Beltran, Carretera Federal a Cuernavaca No. 6020, Col. San Andres, 14400, Totoltepec (MX)

( * ) Notice: Subject to any disclaimer, the term of this patent is extended or adjusted under 35 U.S.C. 154(b) by 123 days.

(21) Appl. No.: 10/482,032

(22) PCT Filed: Jun. 26, 2002

(86) PCT No.: PCT/MX02/00057

§ 371 (c)(1),
(2), (4) Date: Jun. 7, 2004

(87) PCT Pub. No.: WO03/001135

PCT Pub. Date: Jan. 3, 2003

(65) Prior Publication Data

US 2004/0256093 A1 Dec. 23, 2004

(30) Foreign Application Priority Data

Jun. 26, 2001 (MX) ..... 006606
Oct. 5, 2001 (MX) ..... 010047
Jan. 25, 2002 (MX) ..... 000919

(51) Int. Cl.
*F28F 3/06* (2006.01)
*F28F 3/12* (2006.01)
*F28F 3/04* (2006.01)

(52) U.S. Cl. ..... 165/168; 165/49; 165/178; 126/662

(58) Field of Classification Search ..... 165/48–49, 165/53, 168, 177, 178; 29/890.035, 890.038; 126/660–663, 675
See application file for complete search history.

(56) References Cited

U.S. PATENT DOCUMENTS 2,289,685 A * 7/1942 Schoen ..... 72/217
2,585,043 A * 2/1952 Sandberg ..... 165/171
2,646,971 A * 7/1953 Raskin ..... 165/134.1
2,661,191 A 12/1953 Sandberg
2,732,615 A * 1/1956 Sandberg ..... 29/890.038
3,111,818 A * 11/1963 Dolan et al. ..... 62/279
4,080,703 A * 3/1978 Beck, Jr. ..... 29/890.038
4,160,476 A * 7/1979 Ashton et al. ..... 165/171
4,285,335 A * 8/1981 Simmons et al. ..... 126/660
4,830,100 A * 5/1989 Kato et al. ..... 165/104.14
5,097,897 A * 3/1992 Watanabe et al. ..... 165/140
5,174,371 A 12/1992 Grillo

FOREIGN PATENT DOCUMENTS

DE 31 21 267 A1 12/1982
EP 0 807 756 A2 11/1997
EP 0 844 447 A2 5/1998
EP 0 930 469 A2 7/1999

(Continued)

*Primary Examiner*—Tho Duong
(74) *Attorney, Agent, or Firm*—Browdy and Neimark, PLLC

(57) ABSTRACT

A plate-tube type heat exchanger not requiring maintenance is described, comprising: a plate with a plurality of channels running parallel along thereof; and, a plurality of tubes housed and secured to said channels, thus forming a circuit for the circulation of a heating fluid, a cooling fluid or a means of heating; the plate includes integrally attachment means associated to each channel, which in their closed position, cover along with its corresponding channel, almost the entire tube external perimeter housing in said channel, thereby securing each of the tubes to the whole plate, without the use of welding and a large contact surface is achieved for the heat conduction between the plate and each one of the tubes.

6 Claims, 14 Drawing Sheets

FOREIGN PATENT DOCUMENTS

| | | |
|---|---|---|
| FR | 1 132 683 | 3/1957 |
| GB | 672721 | 5/1952 |
| GB | 2 158 215 A | 11/1985 |

* cited by examiner

PLATE-TUBE TYPE HEAT EXCHANGER

FIELD OF THE INVENTION

The present invention relates to techniques employed in designing and manufacturing heat exchange equipment, and more particularly, it is related to a plate-tube type heat exchanger not requiring maintenance.

BACKGROUND OF THE INVENTION

Generally, plate-tube type heat exchangers are comprised by a plurality of tubes and plates, which are bonded to each other by mechanical fastening or tack welded in order to shape the exchanger structure.

Particularly, such heat exchangers are used as condenser and evaporator in domestic and commercial refrigeration systems, they can also be found on water heaters by means of solar energy, air heaters including inside the tubes, an electric resistance, natural convection static condensers, forced air condensers, natural convection static evaporators and forced air evaporators.

In spite of the widely spread use of these equipments, they have been observed as presenting some drawbacks. In first instance, it may be said that manufacturing process of these equipments is quite complex, since upon being comprised of multiple components, steps to assemble them are burdensome, such as the bonding step between tubes and plates via tack welding, in which it is necessary to bond the tubes one by one to the plates.

Likewise, such a traditional method of binding tubes and plates is not that suitable for the equipments previously mentioned to achieve a efficient heat transfer between the environment and the heating or refrigeration fluid which is inside the tubes, particularly, because the contact surface between tubes and plates is significantly reduced, as may be seen in FIG. 1, showing a cross sectional cut of a "half coverage" type assembly used in plate-tube type heat exchangers of the prior art. In such an assembly, a tube is housed in a plate channel, remaining fixed and contacting directly therewith only through a welding point.

A variant of this traditional method of assembly by welding can be appreciated in FIG. 2, (total coverage), wherein a pair of plates similar to those in FIG. 1 are welded to each other by welding tacks, enclosing the tube between the channel thereof. This variant is neither efficient, since most of times the tube does not fit correctly the space formed by the plate channels, thus having a little direct contact between plates and tube for heat conduction.

On the other hand, there is an additional problem related to maintenance and cleaning of these equipments, specially forced air condensers which include fins, such as those used in domestic or commercial refrigeration systems. In said condensers, spacing between fins is significantly reduced, generally between 2 to 3 mm, which favors adhesion and accumulation of dust, grime and crap therebetween. Said accumulation becomes so important that in many cases, the air passage through fins may be obstructed, thereby causing reduction in condenser's heat exchange ability with the environment and consequently, the refrigeration system stops functioning and cooling properly, affecting other elements of the refrigeration system. Additionally, cleaning said dust or grime adhered to the fins is made difficult due to the space quite reduced existing between fins.

Thus, in the state of the art, it may be found systems which intent to reduce on one hand, the assembly steps of these heat exchangers, such is the case of evaporator described in U.S. Pat. No. 2,212,912, which is formed from an extruded sheet integrally including tubes and fins. However, in order to give the evaporator a final shape, the tubes included in said plates need to be welded to a header or headers using several accessories. Similarly, when it is desired to form condensers with a higher capacity, it is necessary to weld bonding two extruded sheets or to change the size of extrusion die used to manufacture said sheets, thus increasing manufacturing costs.

On the other hand, the European Patent No. 0157370, is directed to a panel for an evaporator or condenser heat exchange, said panel is also formed from an extruded sheet which includes a plurality of oval-shape grooves in cross section; inserting a tube in each of said grooves, said tube undergoes a plastic deformation at its circular wall to refill and to fit the oval contour of the groove walls, thus remaining fixed inside, reason why it is not necessary to use welding in order to bind tubes to the extruded sheet. However, when it is desired to bind two panels to form a larger condenser, this document only provides the use of a piping to connect both panels, without mentioning the existence of a direct and firm bonding therebetween; this lack does not allow to manipulate such panels together so as to form different condenser or evaporator configurations and arrangements.

Finally, both documents from the prior art, do not consider among its objects to form a heat exchanger, on which said problems regarding adhesion, accumulation, and dust and grime cleaning between its components are minimized, which as mentioned above, decrease the capacity of equipment performance.

An additional prior art document is U.S. Pat. No. 2,732,615, related to a method for securing a tube to a metal plate, whereby the plate is deformed to form a channel, and further to the placement of a tube in said channel, pressing the plate against the tube in order to deform it and secure it. This document does not show how to join two or more plates in order to form a tridimensional heat exchanger, neither it indicates the employment of alternative extruded plates.

Accordingly, it has been sought to suppress the drawbacks of the tube-plate-type heat exchangers from the current art, and to provide a tube-plate-type heat exchanger not requiring maintenance, of a very simple and convenient construction, which allows to reduce the number of components and work used during its manufactures, thus eliminating the use of welding to join the tubes and plates, or to join two or more plates to each other, in which cleaning of dust and grime that may be adhered and accumulated between its components is easy.

OBJECTS OF THE INVENTION

Having in mind the prior art drawbacks, it is an object of the present invention to provide a tube-plate-type heat exchanger not requiring maintenance, involving a single assembly process during its manufacturing.

An additional object of the present invention, is to provide a tube-plate-type heat exchanger not requiring maintenance, wherein there is a large contact surface between tubes and plates.

A further object of the present invention, is to provide a tube-plate-type heat exchanger not requiring maintenance, wherein welding to firmly join tubes to plates is not used.

Yet another object of the present invention, is to provide a tube-plate-type heat exchanger not requiring maintenance, wherein two or more plates can be firmly joined to each other, without the use of welding.

It is even a further object of the present invention, to provide a tube-plate-type heat exchanger not requiring maintenance, wherein cleaning of dust and grime that may be adhered between its components is easy.

BRIEF DESCRIPTION OF THE DRAWINGS

The novel features of the present invention are set forth with particularity in the appended claims. The invention itself, however, both for its organization and for its operating method, together with further objects and advantages of the invention, will be best understood by reference to the following description of specific embodiments, when taken in conjunction with the accompanying drawings, in which:

DETAILED DESCRIPTION OF THE INVENTION

Figure 1:
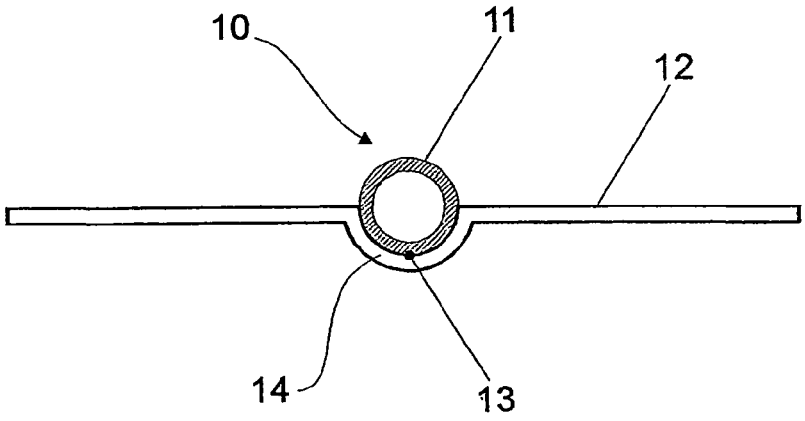
FIG. 1 is a cross sectional view of a "half coverage" assembly, used in the tube-plate-type heat exchangers of the prior art.

Referring in detail to the accompanying drawings, in FIG. 1 is shown a "half coverage"-type assembly 10 used in plate-tube type heat exchangers of the prior art. In said assembly, a tube 11 is housed in the channel 14 of a plate 12, remaining fixed and making a direct contact to it only through a welding point 13.

Figure 2:
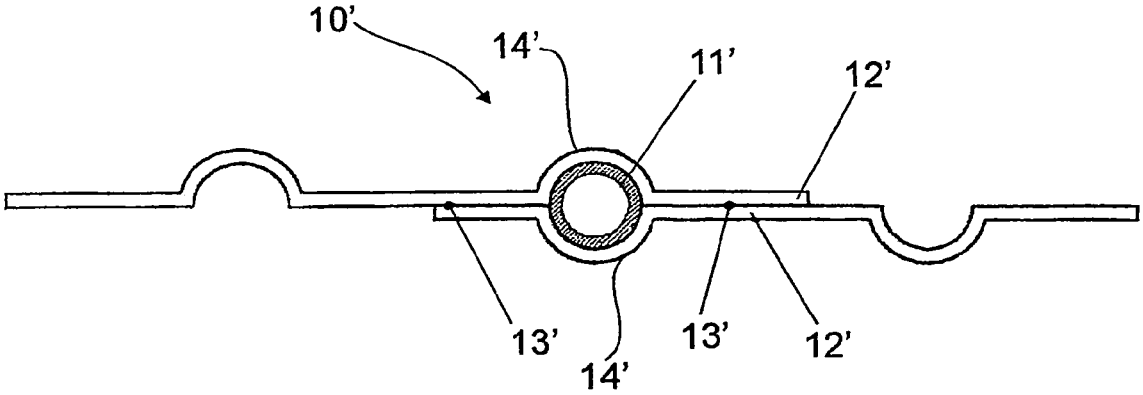
FIG. 2 is a cross sectional view of a "total coverage" assembly, used in the tube-plate-type heat exchangers of the prior art.

In this sense, in FIG. 2 a "total coverage" type assembly used in the prior art is shown. In such assembly, a pair of plates 12' are welded each other via welding points 13', enclosing tube 11' between channels 14' thereof. However, in many cases, the tube 11' does not fit suitably the space formed by plate channels 14', thus having a little direct contact between plates and tube for heat conduction.

Figure 3:
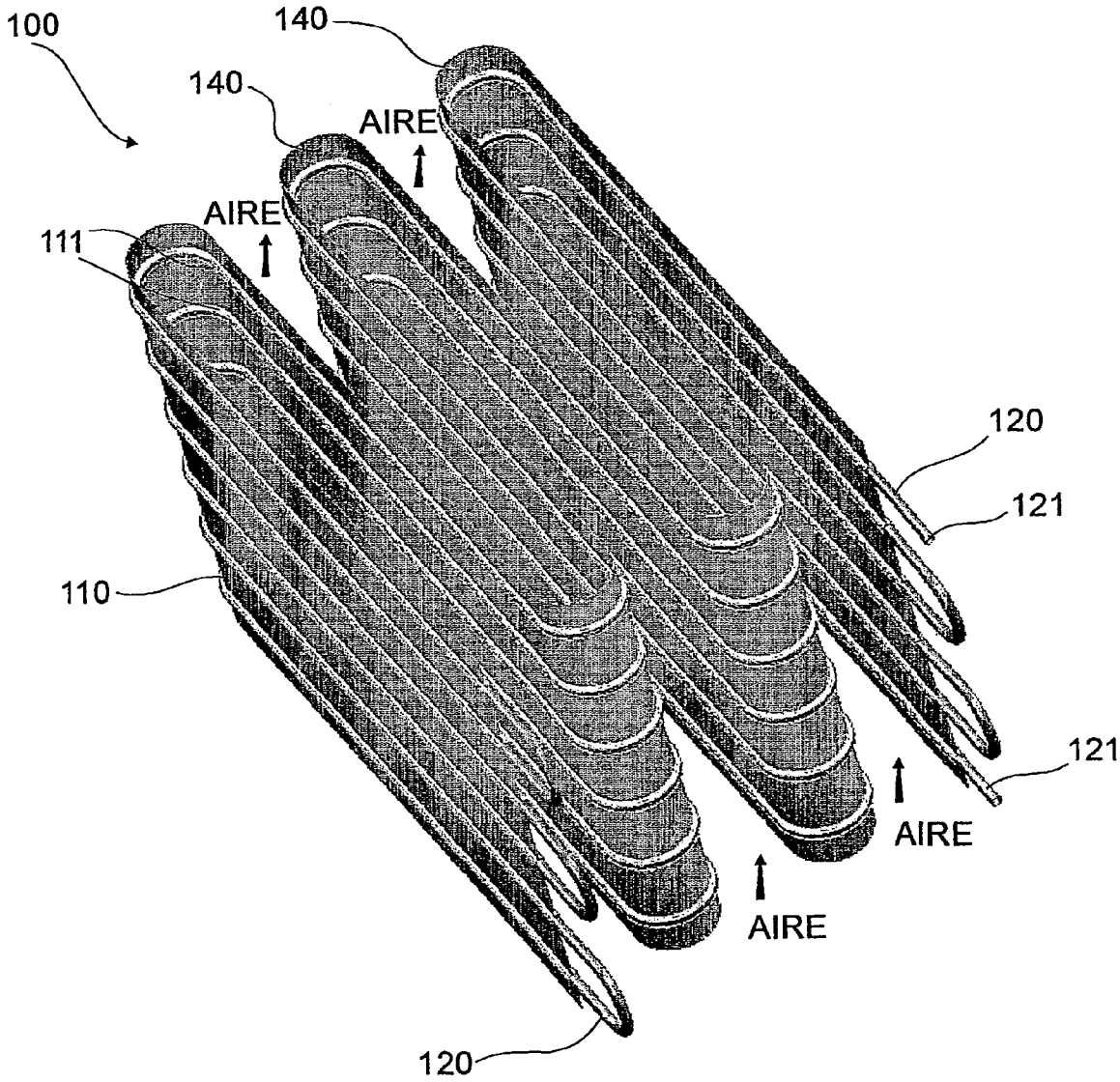
FIG. 3 is a top perspective view of a tube-plate-type heat exchanger not requiring maintenance, constructed in accordance with the principles of the present invention.

On the other hand, specific reference is now made to FIG. 3, in which a plate-tube type heat exchanger 100 not requiring maintenance is shown, as constructed according to a particularly specific embodiment of the present invention, which must be considered as illustrative rather than limitative.

Figure 4:
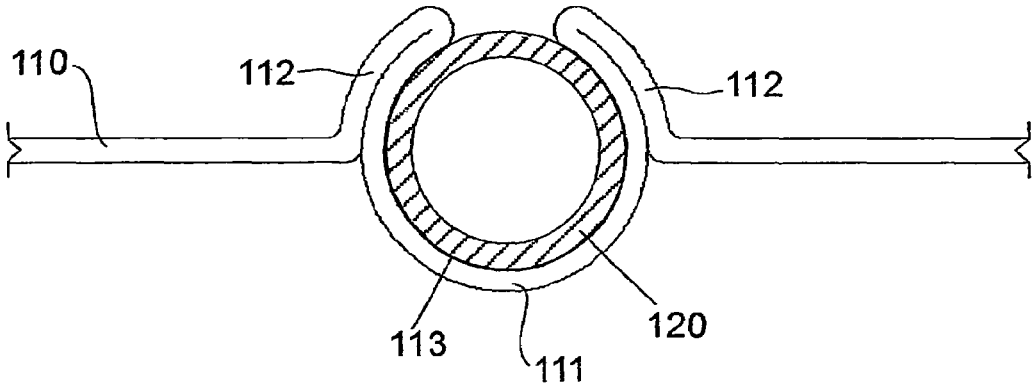
FIG. 4 is a partial cross sectional view of the plate of the tube-plate-type heat exchanger in FIG. 3, which includes a tube housed and secured in one of the channels thereof.
Figure 5:
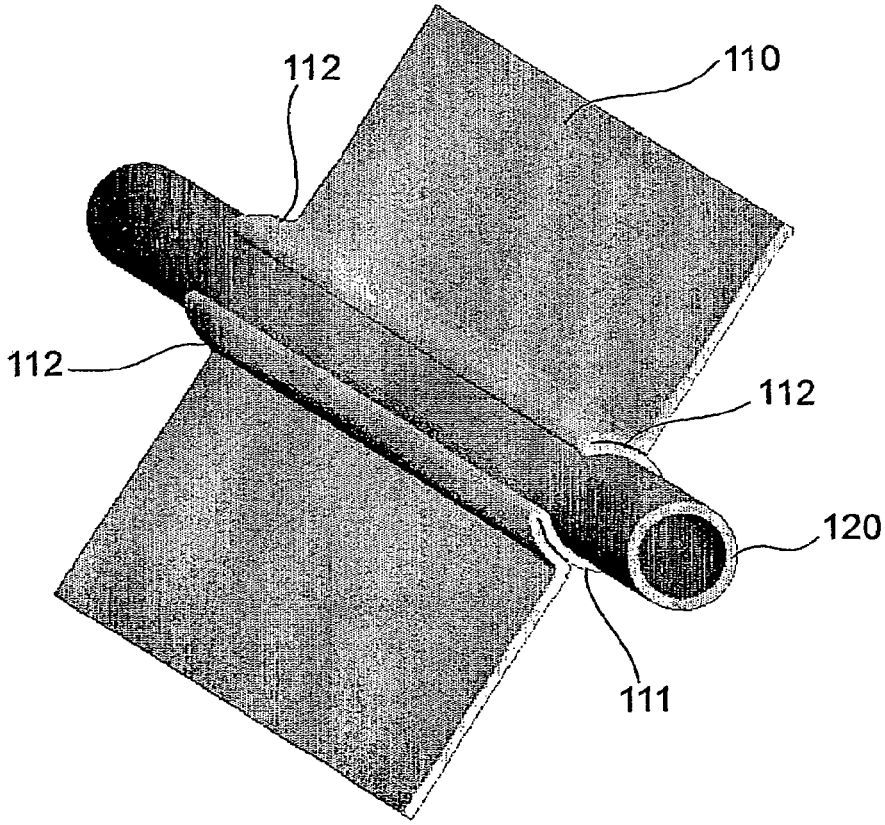
FIG. 5 is a top perspective view of the plate with the tube housed and secured, shown in FIG. 4.

In general terms, the plate-tube type heat exchanger 100 comprises: a plate 110 with a plurality of channels 111 running parallel along thereof; and, a plurality of tubes 120 housed and secured to said channels 111, thus forming a circuit for the circulation of a heating fluid, a cooling fluid or a means of heating. Plate 110 includes integrally attachment means 112 associated to each channel, as shown in FIG. 4; which in their closed position, cover along with its corresponding channel, almost the entire tube external perimeter housing in said channel, thereby securing each of the tubes 120 to the whole plate, without the use of welding and at the same time, a large contact surface 113 is achieved for the heat conduction between plate 110 and each one of the tubes 120, as can be seen in FIGS. 4 and 5.

On this respect, the plurality of attachment means 112, are preferably longitudinal plates from the same plate formed by mechanical means, and extending from both sides of each one of the channels 111. In this embodiment, channels 111 are preferably semicircular or "C"-shaped in its cross section; such that when said attachment means 112 are in their closed position, they function as a mechanical clamp which in conjunction with its corresponding channel cover at least 270° approximately of the tube external perimeter 120 housed in said channel, thereby impeding in the entire plate the free movement of each one of the tubes 120 and a large contact surface 113 is generated for heat conduction between the plate and each one of the tubes 120, provided that such components make full contact without using welding.

Figure 6:
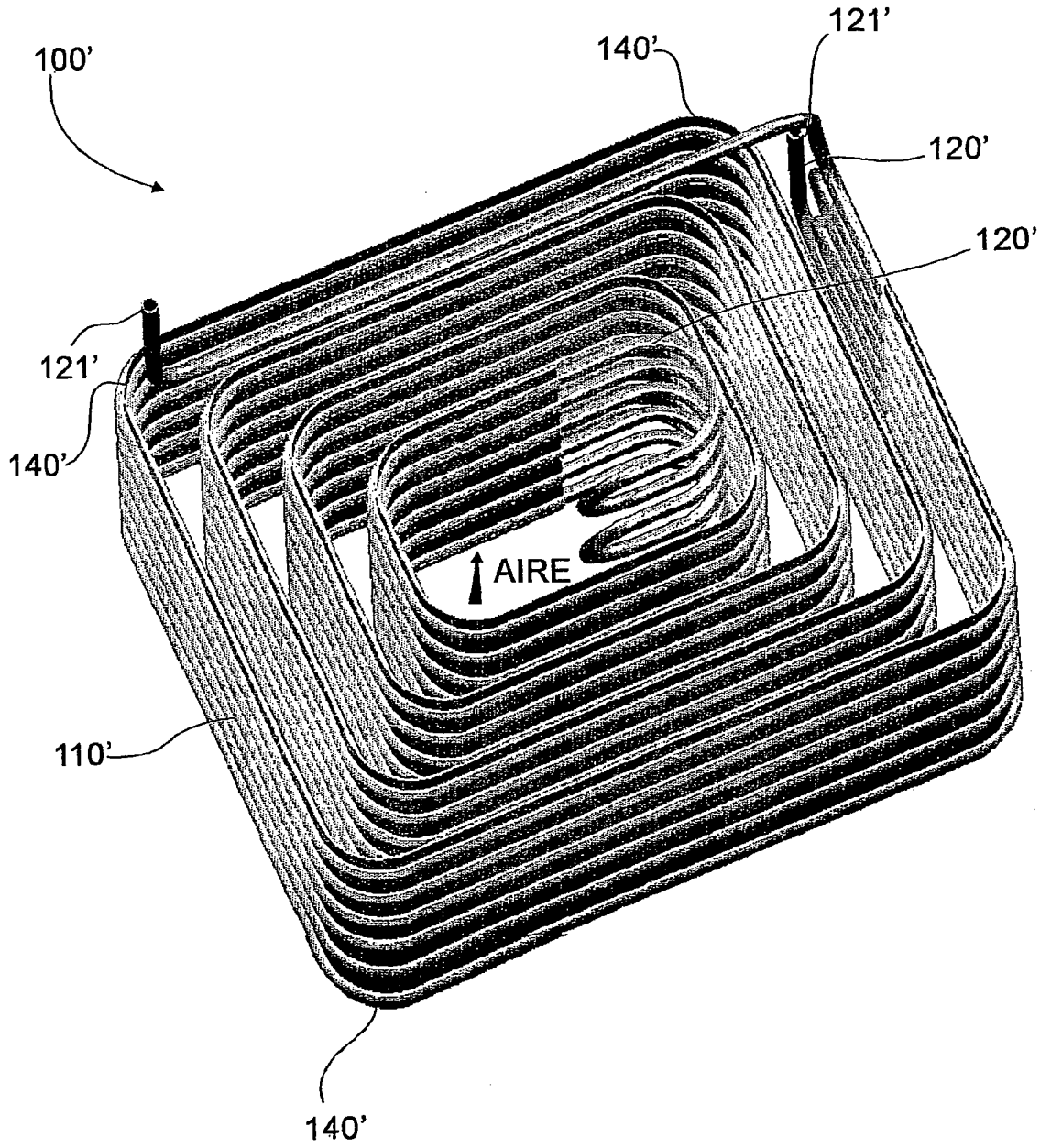
FIG. 6 is a top perspective view of a second configuration that may adopt the tube-plate-type heat exchanger of the present invention.

This particular form of attachment between tubes and the plate eliminating the use of welding, allows the construction of heat exchangers of different configurations, such as the "coil" shape structure shown in FIG. 3 or the "snail" shape structure of FIG. 6.

Particularly, plate 110 with the tubes secured is observed in FIG. 3, including a folding 140 at a determined distance, through its cross section at an angle of about 180°, forming a "coil" shape structure, wherein the minimum spacing distance between segments of the plate located at each side of said folding is at least of 20 mm. More specifically, it is preferred that said spacing distance be between 20 mm to 30 mm, thereby obtaining a compact exchanger, with a large area of heat exchange, allowing a free passage of air therethrough, and preventing mostly the adhesion and accumulation of dust, rubbish, or grime on its surface. Therefore, the exchanger is suitable to be used as a forced air condenser in commercial and/or domestic refrigeration equipments, such as food and beverage refrigerators and freezers.

In FIG. 6, a heat exchanger 100' is shown with an arrangement in "snail" shape, in which the plate 110' with secured tubes, includes every determined distance a folding 140' through its cross section at an angle of approximately 90°, thus forming a "coil" or "snail" shape structure, whose walls are spaced each other a minimum distance of at least 20 mm, preferably such a spacing distance is from 20 mm to 30 mm, achieving a compact structure, of a large area of heat exchange, in which dust, grime and rubbish that might be adhered, does not obstruct air circulation between exchanger walls, being suitable to be used as a forced air condenser in commercial and/or domestic refrigeration systems.

Finally, it is important to establish that in heat exchangers 100 and 100', tube ends 121 and 121' protrude from the plate to make the necessary input and output connections with the rest of the system. Regarding the manufacturing materials of these exchangers components, both the plate 110 and 110' and tubes 120 and 120' are made of iron, galvanized iron, aluminum, copper or the like.

Figure 7:
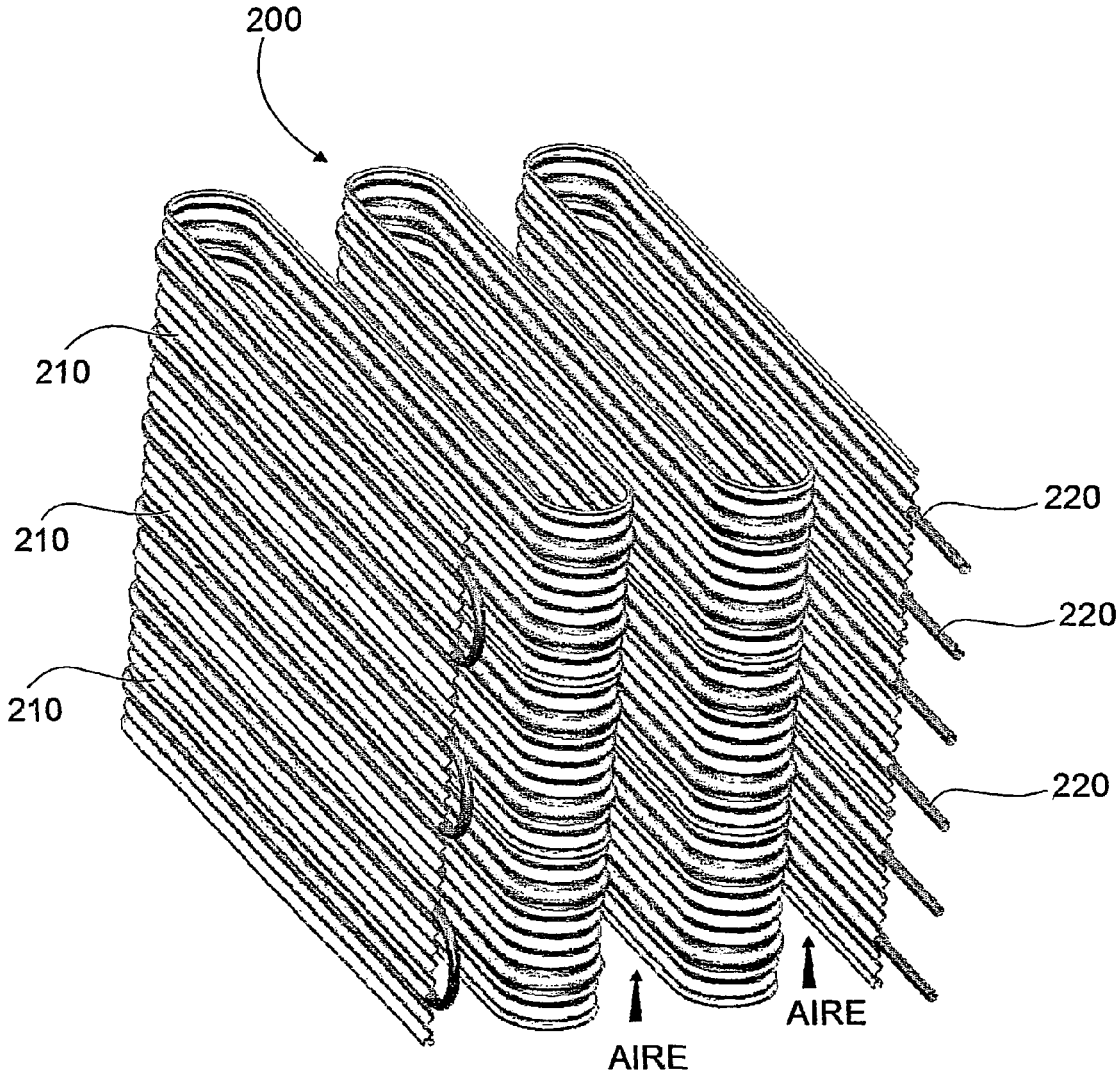
FIG. 7 is a top perspective view of a tube-plate-type heat exchanger not requiring maintenance, constructed in accordance with a first alternative embodiment of the present invention.
Figure 8:
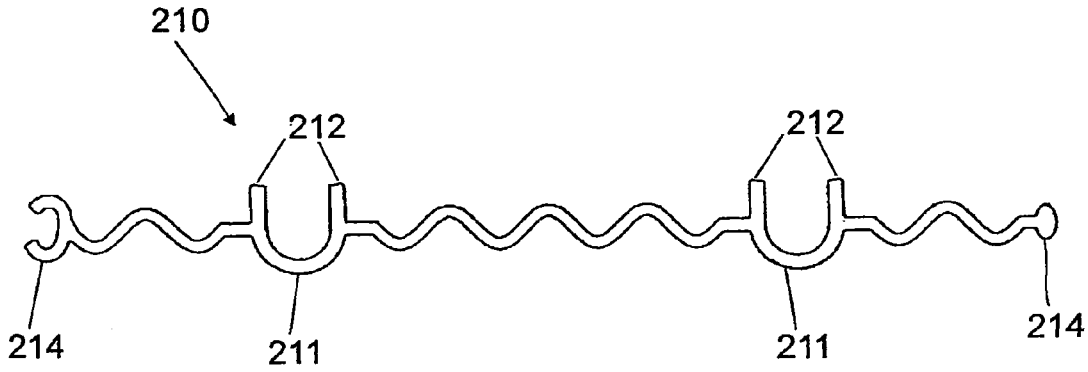
FIG. 8 is a cross sectional view of an extruded profile plate of the heat exchanger shown in FIG. 7.

Referring now particularly to FIG. 7, a heat exchanger 200 of the plate-tube type not requiring maintenance is shown, constructed in accordance to a first particularly preferred embodiment of the present invention, which comprises in general: a plurality of extruded profile plates 210 joined to each other, each one including a plurality of channels 211 running parallel along the plate; and, a plurality of tubes 220 housed and secured in said channels 211, thus forming a circuit for the circulation of a heating fluid, a refrigeration fluid or a means of heating. The extruded profile plates 210 include integrally attachment means 212 associated to each channel, such as shown in FIG. 8, which in their closed position, cover together with its corresponding channel almost fully the external surface of tube housed in said channel; thereby securing each one of the tubes 120 to each one of said plates 210, without the use of welding and at the same time, a large contact surface 213 is generated for the heat conduction between plates 210 and each one of the tubes 220. Likewise, said extruded profile plates 210 include integrally in their ends parallel to the channels, coupling means 214, to be firmly joined to each other, without using welding. All of the above mentioned, may be observed in FIGS. 8 and 9.

Figure 9:
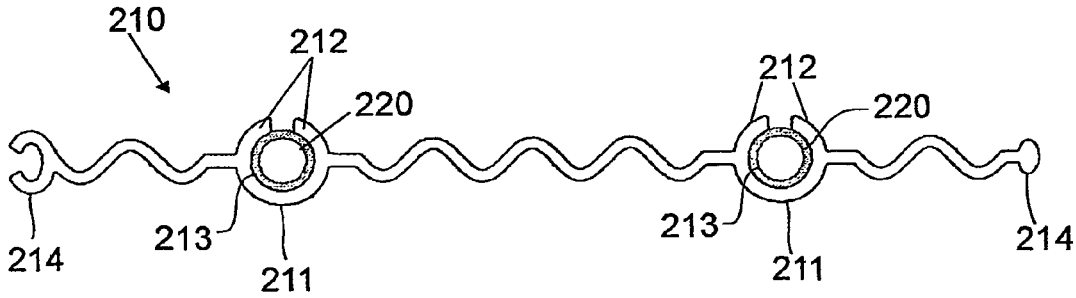
FIG. 9 is a cross sectional view of the extruded profile plate shown in FIG. 8, including tubes housed and secured in the plate channels.
Figure 10:
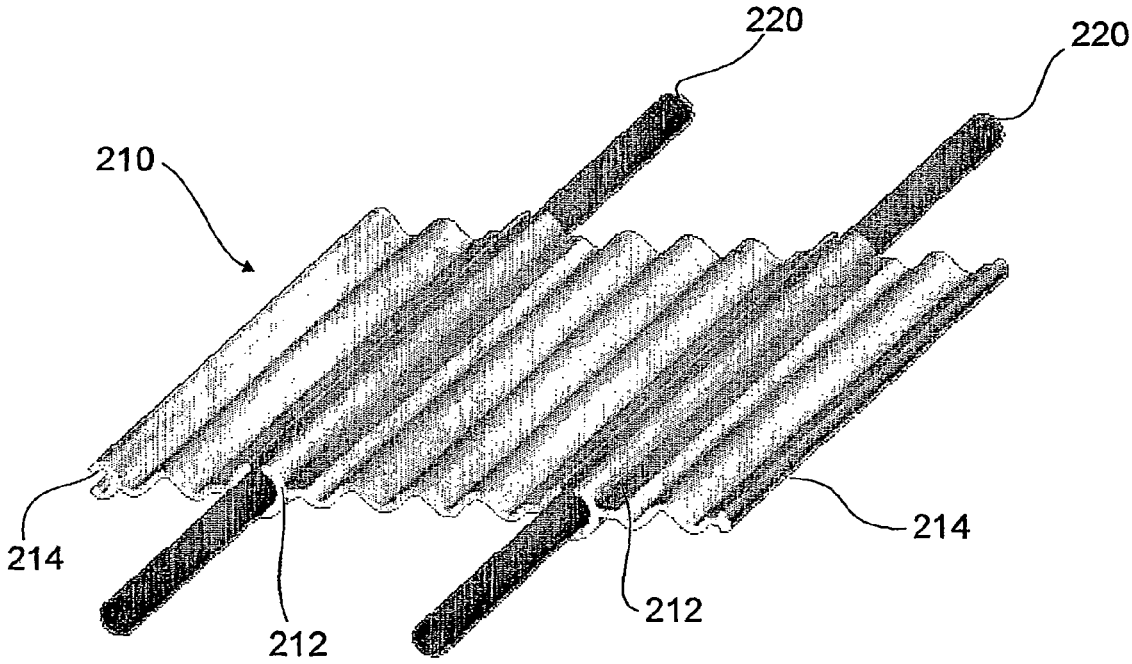
FIG. 10 is a top perspective view of the extruded profile plate in FIG. 9.

Additionally, it may be said that in the open position of such attachment means 212, these are extended from both sides of its corresponding channel, forming therewith a "U" shape housing in cross section, and where such attachment means 212 are in its closed position, they work as a mechanical clamp which along with said channel, cover at least 270° of the external perimeter of tube 220 housed in the channel, thereby impeding in each one of the plates free movement of tubes and a large contact surface 213 is generated for heat conduction between tubes and plates, provided that such components make full contact without using welding, as may be seen in FIGS. 9 and 10.

Referring to the plate, its surface may be flat or wavy, being preferred to use a wavy surface plate, which allows increasing the effective area of heat transfer, compared to a flat plate.

Figure 11:
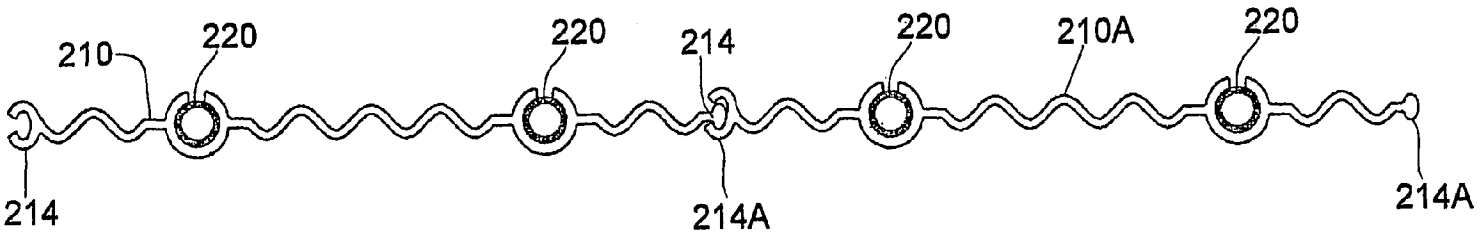
FIGS. 11 and 11A, are cross sectional views for showing the assembly between two extruded profile plates with tubes housed and secured.
Figure 11A:
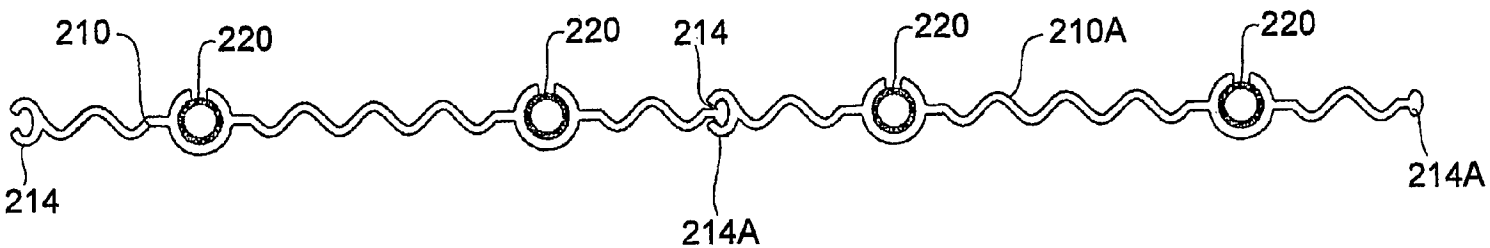

With respect to the coupling means 214, it may be mentioned that they are located at the plate ends parallel to channels 111, and are preferably of the "male-female" type. Specifically, when it is desired to join two extruded profile plates 210 to each other, the male end of one of them is introduced into the female end of the other, which closes thereafter by means of pressure, thus achieving to firmly join two or more extruded profile plates 210 without using welding, which also allows a contact surface to exist for the heat conduction between plates, such as may be observed clearly in FIGS. 11 and 11A.

Figure 12:
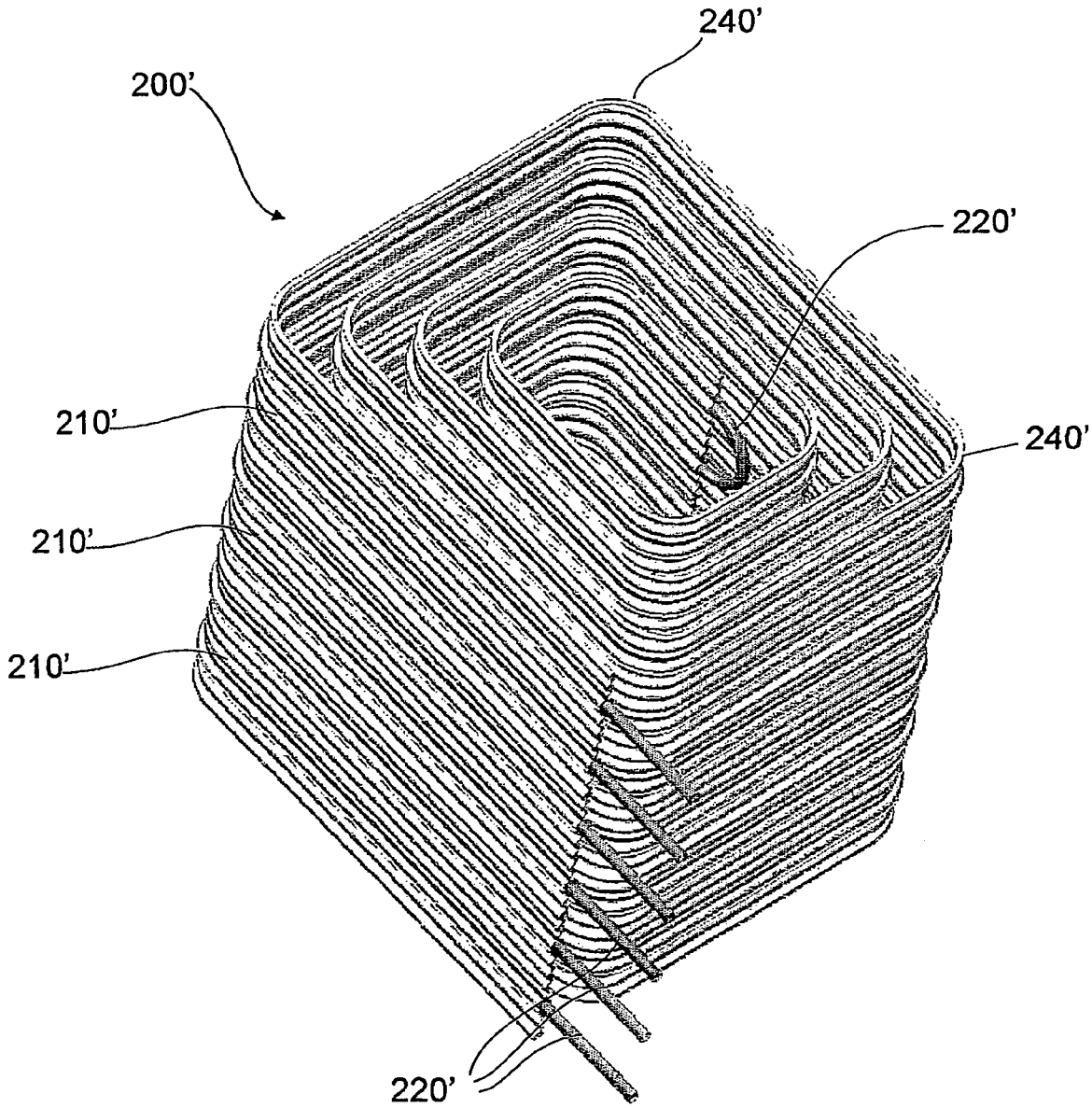
FIG. 12 is a perspective view of a second configuration that may adopt the embodiment shown in FIG. 7.

This particular way of attachment between tubes and plates by attachment means 212, as well as the easiness to join two or more extruded profile plates by such coupling means 214, which eliminate the use of welding, allow to build heat exchangers of very different configurations and sizes, such as those shown in FIGS. 7 and 12, both configurations presenting most of the characteristics mentioned for the exchangers of FIGS. 3 and 7 previously described. Specially, exchangers 200 and 200' of this first embodiment, maintain such minimal spacing distance between walls formed by the plate, which is at least 20 mm, more preferably between 20 mm to 30 mm. Likewise, its principal application is as forced air condensers used in domestic and commercial refrigeration equipments.

Concerning the manufacturing materials, it may be mentioned that the plate is made preferably of aluminum, provided that such material is easy to handle under the extrusion processes known in the prior art. On the other hand, the tubes may be manufactured in iron, copper or aluminum.

Figure 13:
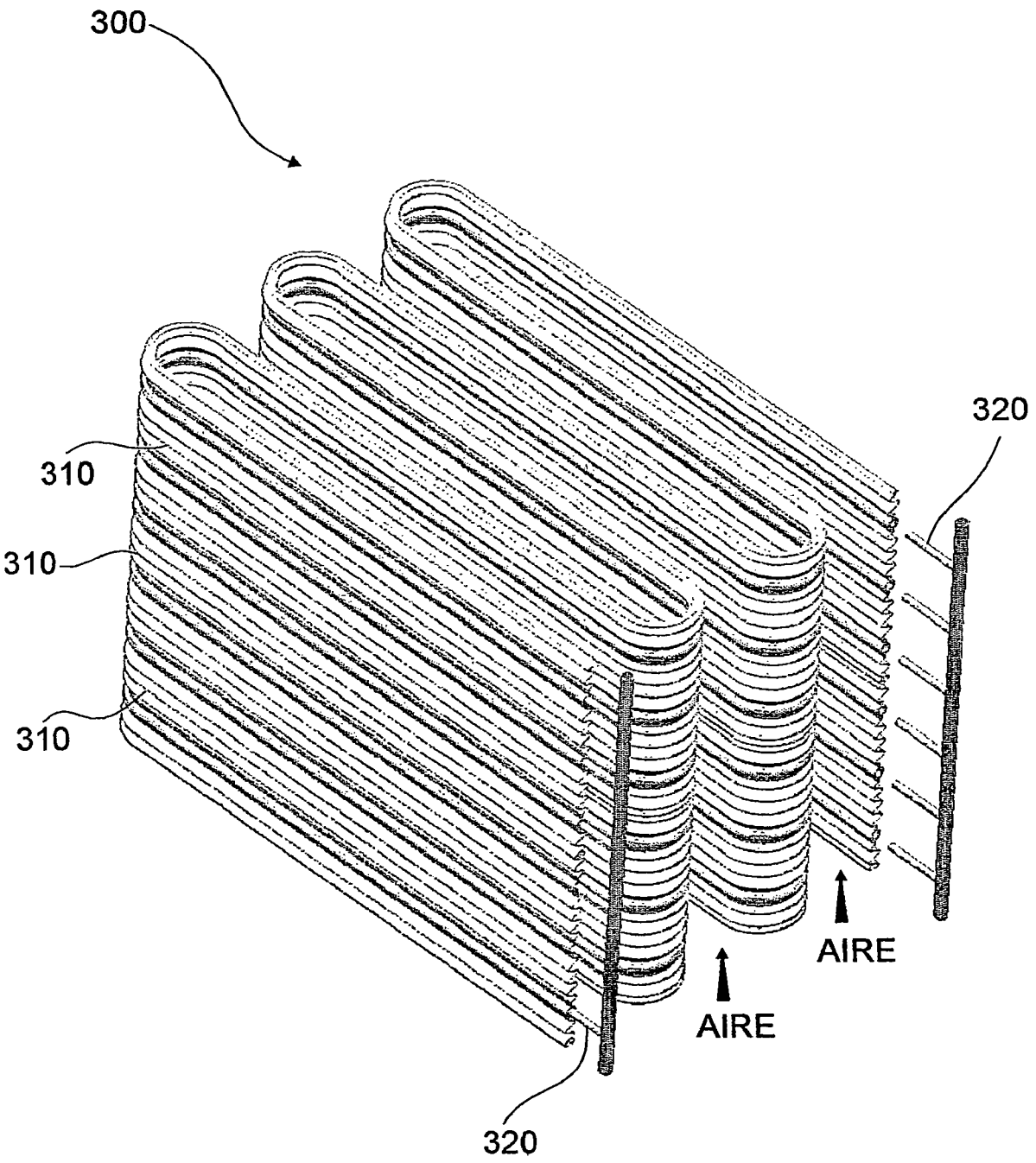
FIG. 13 is a perspective view of a tube-plate-type heat exchanger not requiring maintenance, constructed in accordance with a second alternative embodiment of the present invention.
Figure 14:
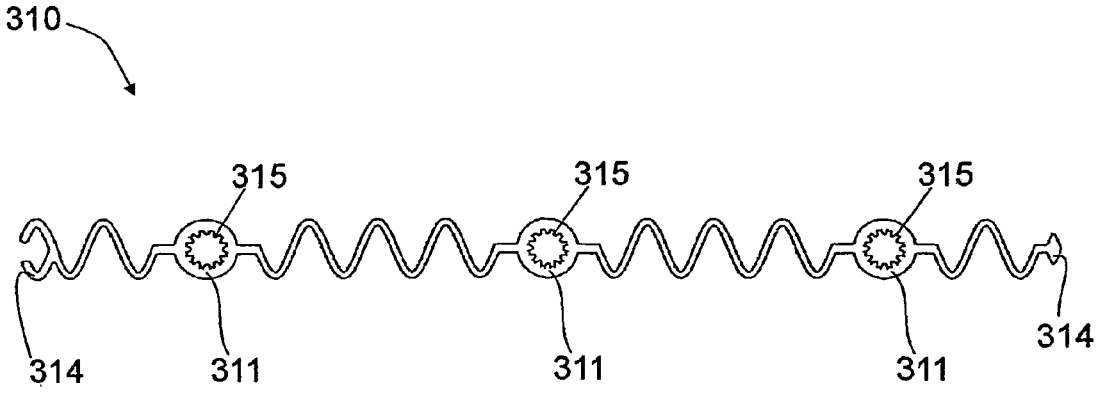
FIG. 14 is a cross sectional view of one of the extruded profile plate of the heat exchanger shown in FIG. 13.

Additionally, referring particularly to FIG. 13, a plate-tube type heat exchanger 300 not requiring maintenance, constructed in accordance to a second preferred embodiment of the present invention is shown, generally comprising: a plurality of extruded profile plates 310 joined to each other, each one including integrally a plurality of tubes or ducts 311, running parallel along the plate, which are interconnected in their ends by connection fixtures 320, forming a circuit for the circulation of a heating fluid, a refrigeration fluid or a means of heating 314 as to firmly join two plates to each other, without using welding, as shown in FIG. 14.

Figure 15:
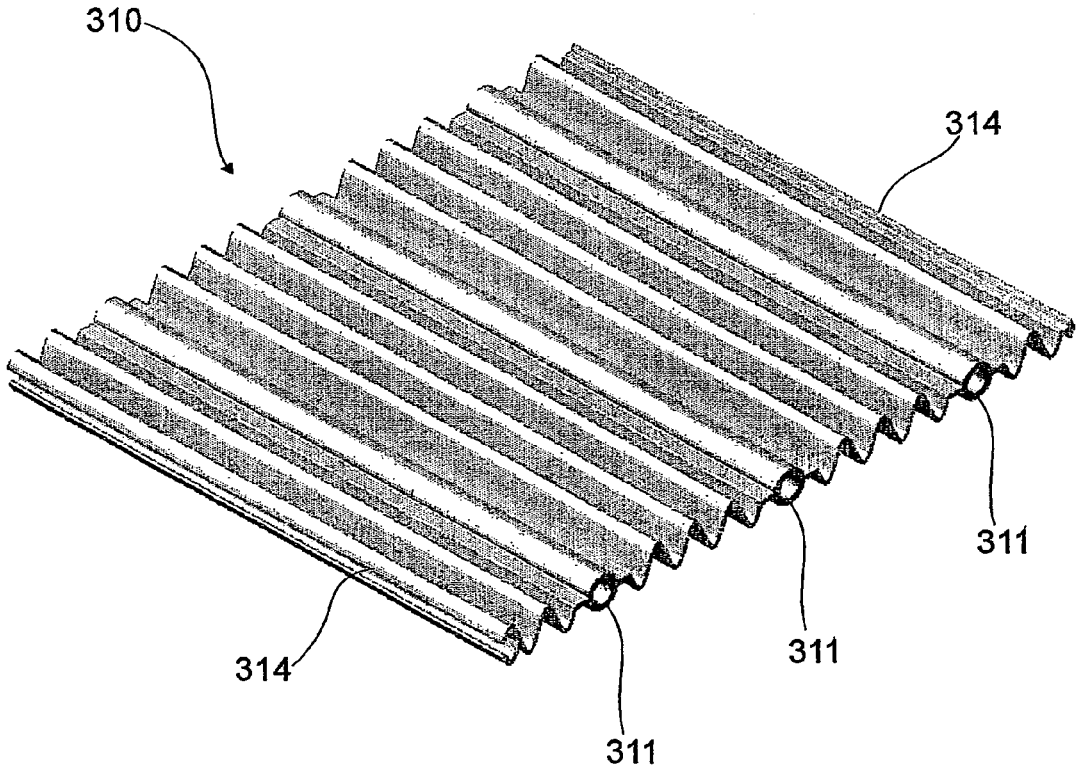
FIG. 15 shows a top perspective view of the plate illustrated in FIG. 14.

In such a figure, as well as in FIG. 15, it may be seen that extruded profile plate used in this second embodiment is somewhat similar to plate 210 above described, whose surface may be flat or wavy, being preferred to use a wavy surface plate, taking advantage at the heat transfer area compared to a flat plate. In this sense, at the internal face of each one of the tubes 311, a plurality of nervures or fines 315 is preferably included as to increase the primary contact surface between the heat exchange means and tubes 311 integrally joined to the plate.

Figure 16:
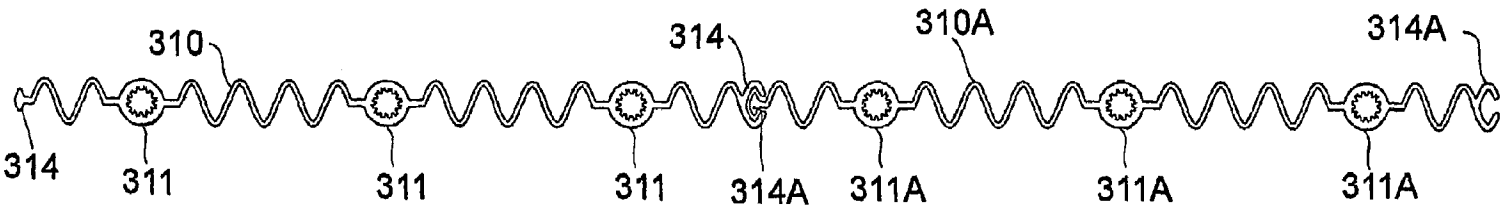
FIGS. 16 and 16A, are cross sectional views for showing the assembly between two extruded profile plates, as shown in FIG. 14.
Figure 16A:
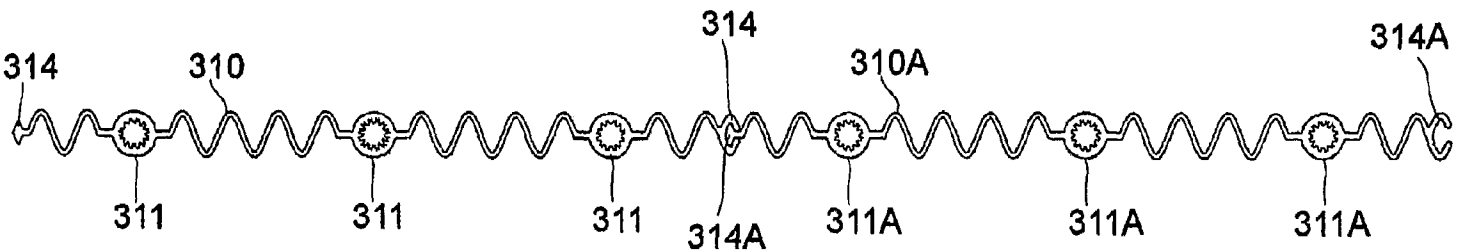

On the other hand, it is shown that coupling means are similar to those previously described for plates 210 of the first embodiment, that is, are of male-female type and are located in the plate ends which are parallel to channels. Said coupling means allow to firmly join two or more plates to each other, without using welding, such as shown in FIGS. 16 and 16A.

Figure 17:
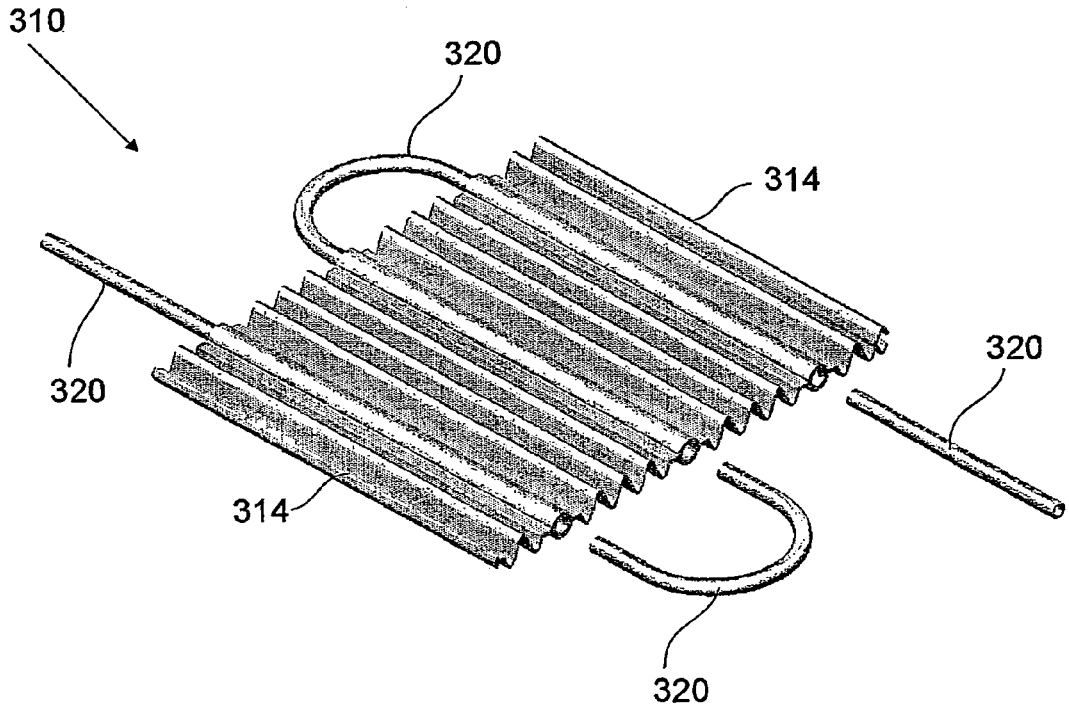
FIGS. 17 and 17A, are exploded views showing the connection of piping and/or accessories to the extruded profile plate shown in FIG. 15.
Figure 17A:
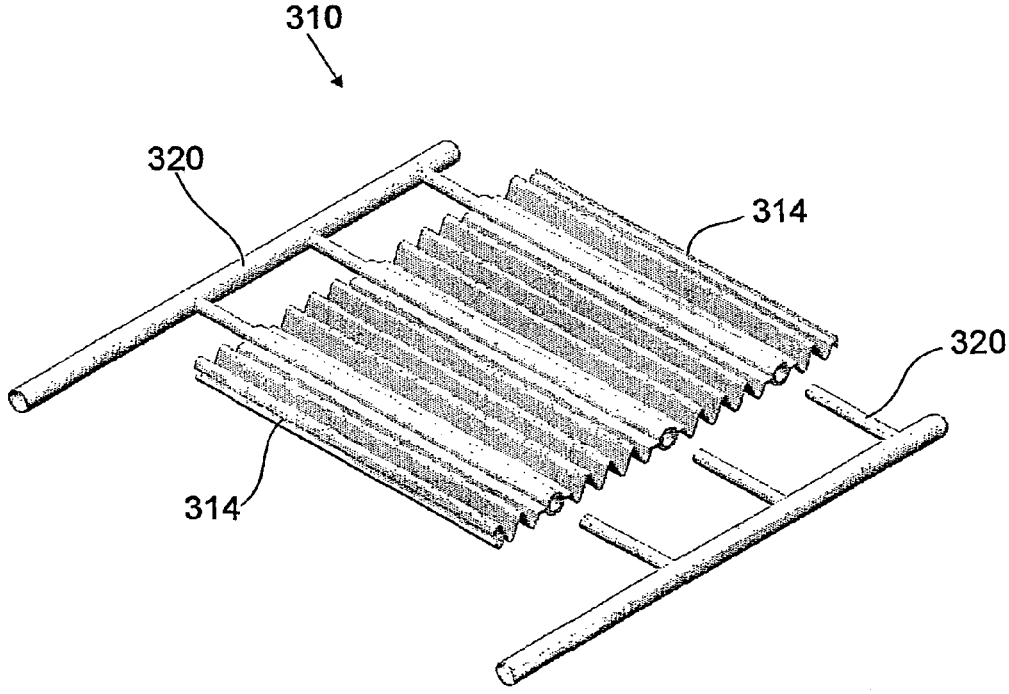

Referring now to FIGS. 17 and 17A, it may be appreciated that in the plate ends 310, tubes integrally included therein, may be interconnected to each other by connection fixtures 320 of different configurations, such as straight tubes, or U-shaped tubes, which are introduced in tubes 311 integrated to the plate and secured thereto in order to form serial and parallel circuits for the heating or refrigeration fluid or heating means.

Figure 18:
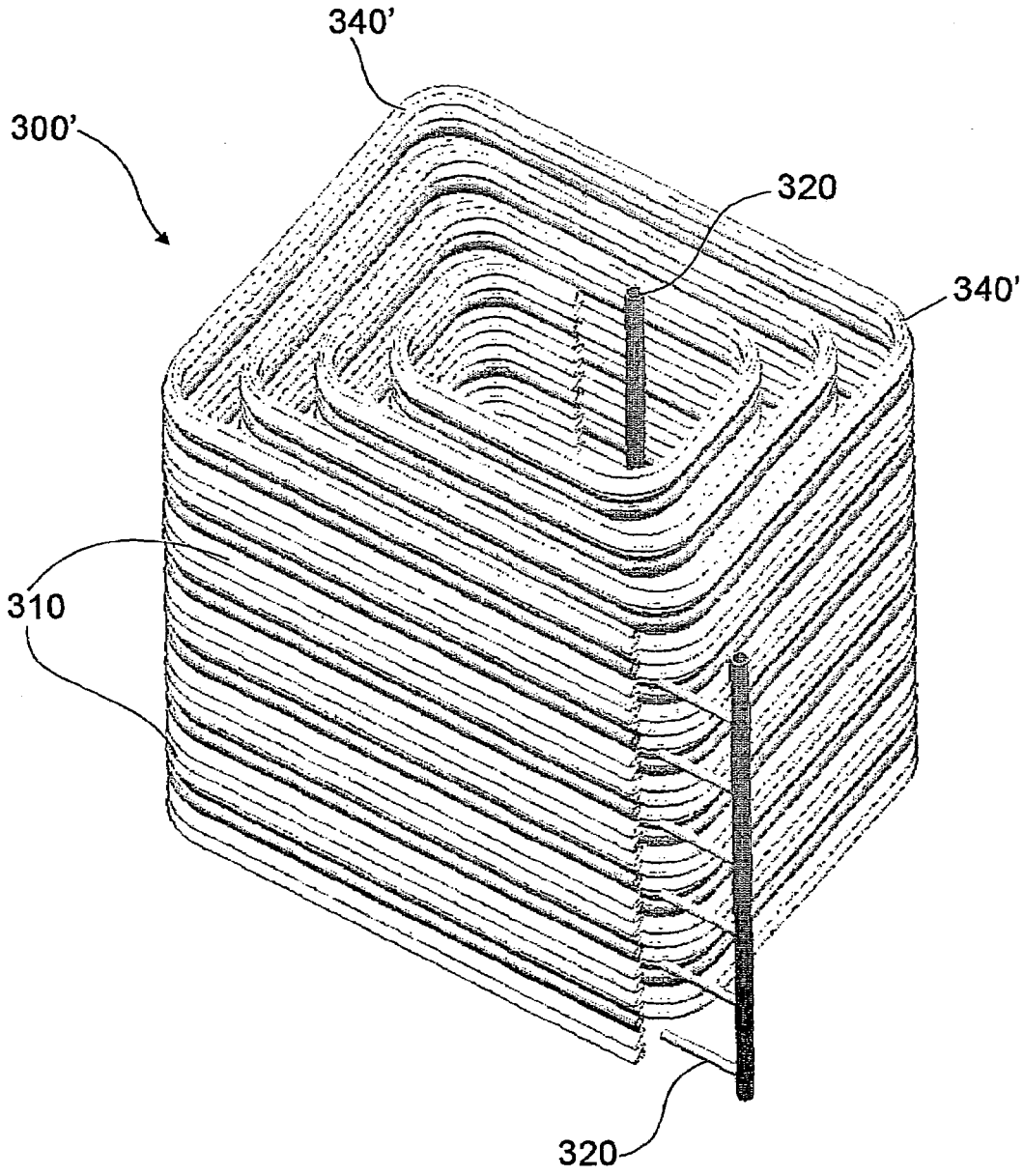
FIG. 18 shows a top perspective view of a second configuration that may adopt the alternative embodiment shown in FIG. 13.

Once said tubes 311 have been interconnected plates may be folded in order to obtain configurations shown in FIGS. 13 and 18, "coil" shape configurations and "snail" shape configurations, respectively, whose characteristics have been previously widely mentioned, including their manufacturing materials.

Finally, it should be noted that time and efforts required to manufacture the heat exchangers of the present invention, is much lesser compared to those known from the prior art, since they essentially include only plate and tubes of easy assembly.

Even though in the foregoing description certain embodiments of the present invention are illustrated and described, emphasis should be made in that numerous modifications are possible to such embodiments without departing from the true scope thereof, such as varying the number of extruded profile plates, number of channels or tubes included therein, or how to fold the plate in order to obtain configurations other than those previously mentioned, keeping the minimum spacing distance, thus preventing fouling problems. The present invention, therefore, should not be restricted except for that required by the prior art and by the appended claims.

The invention claimed is:

1. A plate-tube type heat exchanger comprising a plurality of extruded profile flat or wavy plates each having a plurality of channels running parallel along the plate, attachment means extending from both sides of each channel forming therewith a "U" shape in cross section; and a plurality of tubes housed and secured in said channels, thus forming a circuit for the circulation of a heating fluid, a refrigeration fluid or heating means;

wherein said attachment means associated to each channel, in their closed position, cover together with its corresponding channel, almost fully the external surface of the tube housed in said channel, thereby securing each one of the tubes to each one of said plates without the use of welding;

said plates including coupling means of the male-female type in their ends wherein the male end of one of them is introduced into the female end of the other, which closes thereafter by means of pressure, in order to firmly join each other without using welding, to form a heat exchanger wherein the plates joined to each other with secured tubes, include a folding at a specific distance through its cross section, at an angle of about 90° or about 180°, forming a coil or snail shaped structure, wherein the spacing distance between segments of the plates located at each side of said folding is between 20 mm and 30 mm, forming a heat exchanger not requiring maintenance.

2. A plate-tube type heat exchanger according to claim 1, wherein the structure of said heat exchanger allows the same to be used as a forced air condenser in commercial and/or domestic refrigeration equipment, in which dust or grime is not accumulated, allowing a free passage of air.

3. A plate-tube type heat exchanger according to claim 1, wherein the plate includes at every determined length, a folding through its cross section at an angle of approximately 90°.

4. A plate-tube type heat exchanger according to claim 3, wherein the structure of said heat exchanger allows the same to be used as a forced air condenser in commercial and/or domestic refrigeration equipments, in which dust or grime is not accumulated, allowing a free passage of air.

5. A plate-tube type heat exchanger according to claim 1, wherein the plate includes at every determined length, a folding through its cross section at an angle of approximately 180°.

6. A plate-tube type heat exchanger according to claim 1, wherein the extruded profile plates are manufactured from aluminum, and the tubes, are manufactured from iron, copper or aluminum.

* * * * *